US005246603A

United States Patent [19]

Tsaur et al.

[11] Patent Number: 5,246,603

[45] Date of Patent: Sep. 21, 1993

[54] FRAGRANCE MICROCAPSULES FOR FABRIC CONDITIONING

[75] Inventors: Liang S. Tsaur, Norwood; Samuel Lin, Paramus, both of N.J.

[73] Assignee: Lever Brothers Company, Division of Conopco, Inc., New York, N.Y.

[21] Appl. No.: 766,477

[22] Filed: Sep. 25, 1991

[51] Int. Cl.[5] ..... D06M 10/08; C11D 17/00

[52] U.S. Cl. ..... 252/86; 252/8.7; 252/8.75; 252/8.8; 252/8.9; 252/174.11; 252/174.3

[58] Field of Search ..... 252/8.6, 8.7, 8.75, 252/8.8, 8.9, 174.11, 174.13

[56] References Cited

U.S. PATENT DOCUMENTS

| | | | |
|---|---|---|---|
| 2,876,160 | 3/1959 | Schoch et al. | 167/82 |
| 3,091,567 | 5/1963 | Wurzberg et al. | 167/42 |
| 3,159,585 | 12/1964 | Evans et al. | 252/356 |
| 3,455,838 | 7/1969 | Marotta et al. | 252/316 |
| 3,758,323 | 9/1973 | Szymanski et al. | 106/529 |
| 3,821,436 | 6/1974 | Fry | 426/213 |
| 3,896,033 | 7/1975 | Grimm, III | 252/8.9 |
| 3,971,852 | 7/1976 | Bremmer et al. | 426/103 |
| 4,073,996 | 2/1978 | Bedenk et al. | 252/8.6 |
| 4,137,180 | 1/1979 | Naik et al. | 252/8.8 |
| 4,152,272 | 5/1979 | Young | 252/8.6 |
| 4,276,312 | 6/1981 | Merritt | 426/96 |
| 4,326,967 | 11/1979 | Melville | 252/8.8 |
| 4,446,032 | 5/1984 | Munteanu et al. | 252/8.8 |
| 4,536,315 | 8/1985 | Ramachandran et al. | 252/8.8 |
| 4,767,547 | 8/1988 | Straathof et al. | 252/8.8 |
| 4,789,491 | 12/1988 | Chang et al. | 252/8.75 |
| 4,806,255 | 2/1989 | Konig et al. | 252/8.8 |
| 4,828,746 | 5/1989 | Clauss et al. | 252/8.8 |
| 4,842,761 | 6/1989 | Rutherford | 252/90 |
| 4,889,643 | 12/1989 | Royce et al. | 252/8.8 |
| 4,898,680 | 2/1990 | Clauss et al. | 252/8.8 |
| 4,911,851 | 3/1990 | Ladd, Jr. et al. | 252/8.8 |
| 4,946,624 | 8/1990 | Michael | 252/174.11 |
| 4,954,285 | 9/1990 | Wierenga et al. | 252/8.8 |
| 5,078,904 | 1/1992 | Behan et al. | 252/8.8 |
| 5,102,564 | 4/1992 | Gardlik et al. | 252/8.9 |
| 5,112,688 | 5/1992 | Michael | 252/8.6 |

*Primary Examiner*—Paul Lieberman
*Assistant Examiner*—William S. Parks
*Attorney, Agent, or Firm*—A. Kate Huffman

[57] ABSTRACT

Composite microcapsules and a method of making the microcapsules, as well as a tumble drier article incorporating the microcapsules are described. The microcapsules comprise particles made of a emulsifiable mixture of a wax material and a fragrance oil which are embedded in a water soluble polymer. The microcapsules have a diameter of less than about 100 microns and are useful for incorporation in tumble drier articles to control the release of fragrance in the drier and prevent loss of fragrance during processing and storage.

14 Claims, No Drawings

FRAGRANCE MICROCAPSULES FOR FABRIC CONDITIONING

FIELD OF THE INVENTION

This invention pertains to a water soluble polymer which encapsulates particles made of an emulsifiable mixture of a fragrance and a wax to form microcapsules which are used to improve the deposition of fragrance onto fabrics.

BACKGROUND OF THE INVENTION

The use of fragrance to provide a pleasing scent to freshly dried fabrics as well as to modify or enhance the fragrance of fabric conditioning articles is both desirable and well known in the art as illustrated in U.S. Pat. No. 4,954,285 issued to Wierenga et al. However, the efficient deposition of such perfumes on fabrics as well as the manufacturing of fabric conditioning articles has not been achieved to date. The volatile perfumes tend to be lost during manufacturing of the tumble drier sheets as well as during their storage and use by the consumer. Various techniques have been tried in the prior art to address these problems. In general, these techniques involve entrapping the volatile fragrance oil with a coating or by mixing the oil with a suitable carrier.

Solid fragrance particles have also been prepared by mixing and absorbing the fragrance oil with a solid carrier to deliver fragrance to a product.

In U.S. Pat. No. 4,152,272 particles are formed from a perfume/wax mixture. The resulting particles are primarily incorporated into an aqueous fabric conditioner composition. This type of perfume/wax particle is undesirable for the manufacture of such particles into a tumble drier sheet because the molten fabric softener actives deposited on the sheets reach temperatures of up to 80° C. Such manufacturing temperatures would cause the majority of the perfume containing particles with melting points below the processing temperature to melt releasing the majority of the fragrance during manufacturing of the sheets rather than being deposited on the drying fabrics. For those wax/perfume particles having melting points above the processing temperature the perfume is extracted by the molten active softener material.

In U.S. Pat. Nos. 4,954,285; 4,536,315 and 4,073,996 perfumed oils are mixed and absorbed with an inorganic carrier such as clay or silica to deliver perfume in detergents and fabric softeners. In U.S. Pat. No. 4,326,967 and EP 334,666 perfumes are emulsified in a wax or solid surfactant and the fragrance oil is released during heat treatment such as in a drier.

A fragrance containing polymer incorporated in detergent compositions comprising a water soluble polymer, a water insoluble polymer and a perfume composition which is part of both the water soluble and water insoluble polymers is described in U.S. Pat. No. 4,842,761. The two polymers are physically associated with each other so that one polymer forms discreet entities in the matrix of the other polymer.

In general, although these free flowing solid particles provide for the controlled release of the oil fragrance, the fragrance oil is generally not sufficiently protected so that it is frequently lost or destabilized during processing. It is also difficult to extract the fragrance when desired during use.

In U.S. Pat. No. 4,842,761 the perfume capsules largely depend on increasing size to increase the amount of deposited on clothes or fabrics and compensate for perfume lost during processing. Additionally, the particles require a large amount of water (e.g. wash or rinse liquor) to release the fragrance oils. Thus, the polymer matrix of the '761 patent would not effectively deliver fragrance at the end of the drying cycle as claimed in the subject invention.

Specifically, water dispersible polymers have been used to encapsulate fragrance oils in conventional spray drying processes as described in U.S. Pat. Nos. 4,276,312; 3,971,852; 3,821,436; 3,758,323; 3,455,838; 3,159,585 and 3,091,567. Such solid particles are made by emulsifying fragrance oils into an aqueous solution of the water dispersible polymer such as gum arabic, starch or gelatin. The emulsion is then sprayed into a column of hot air to yield free flowing microcapsules with the oil entrapped or encapsulated inside the water soluble polymer. Such spray drying techniques have been widely employed to make encapsulated fragrance particles. However, the conventional processes are not suitable for manufacturing the claimed composite microcapsule because large aggregates of perfume wax mixture are formed in the emulsion solution and can not be spray dried.

It is thus an object of the invention to provide fragrance encapsulated particles which will prevent the release and loss of the majority of the fragrance oil during processing, storage and use of fabric conditioning articles and which will release the majority of the fragrance onto drying fabrics.

Additionally, the fragrance particles may be incorporated in a fabric softening composition and applied to a dispensing means to produce an article for use in automatic clothes dryers to condition fabrics.

Another object of the invention is to provide a novel process for forming the claimed microcapsules to avoid loss of fragrance oils during processing, storage and use.

SUMMARY OF THE INVENTION

The invention relates to composite microcapsules comprising a water soluble polymer encapsulating individual core particles formed from an emulsifiable mixture of wax and perfume. The emulsifiable mixture has a melting point of less than 100° C., preferably 35° C.–90° C. and most preferably from 45° C. to 85° C. The emulsifiable mixture should be emulsifiable in an aqueous solution to form core particles with a diameter of less than 5 micrometers and preferably less than 1 micrometer. The diameter of the microcapsules is no greater than 100 microns and preferably less than about 40 microns.

The emulsifiable mixture may be optionally combined with a surfactant. The microcapsules are prepared by forming an emulsion of the emulsifiable mixture and the water soluble polymer then spray drying the emulsion to form the microcapsules. The microcapsules may be coated onto a dispensing means for release onto fabrics in an automatic clothes drier. In such an application, moisture from the washed fabrics at least partially dissolves the water soluble polymer and the perfume diffuses out of the microcapsules or the released core particles. Temperatures of the drying cycle in the clothes drier may accelerate the release of the perfume by melting the wax of the core materials.

The wax materials which may be used to form the emulsifiable mixture in the invention include hydrocarbons such as paraffin wax and microcrystalline wax.

Surfactant materials which may be used may be either cationic, anionic or nonionic surfactants such as an ethoxylated primary alcohol nonionic surfactant derived from C16, C30, C40 and C50 average carbon chain length primary alcohols; a fabric softening component; or alkyl sulfonate. Preferred surfactant materials are an ethoxylated primary alcohol and a cationic fabric softening compound, such as a quaternary ammonium compound.

Suitable water soluble polymers for use in the invention include synthetic polymers and natural or modified natural polymers with molecular weights of less than 100,000.

DETAILED DESCRIPTION OF PREFERRED EMBODIMENTS IN THE COMPOSITE MICROCAPSULES

The composite microcapsules of the invention may be added to tumble drier articles to eventually release perfume compositions onto fabrics. The microcapsules are composed of small particles of an emulsifiable mixture of a wax and perfume composition optionally combined with a surfactant. The particles are individually embedded in a water soluble polymer matrix. Thus multiple release modes are used to deposit the perfume fragrance onto fabrics. Specifically the polymer matrix dissolves, partially or completely, upon contact with wet fabrics and the perfume of the particles diffuses out. Diffusion is accelerated by melting the wax of the particles. The microcapsules may be incorporated in a tumble article to releasably control the depositing of the perfume fragrance onto fabrics during drying.

The water soluble polymer matrix of the microcapsules at least partially dissolves upon contact with washed fabrics from a washing cycle. Perfume then may diffuse from released particles or from particles still within the partially dissolved polymer material.

The emulsifiable material has a melting point defined as the highest transition temperature which is measurable by a conventional Differential Scanning Calorimeter above the point where the emulsifiable mixture becomes a flowable liquid. The core materials should be emulsifiable in an aqueous solution. The melting point of the particles is less than about 100° C., preferably about 35° C. to about 90° C. and most preferably from about 45° C. to about 85° C.

In a preferred embodiment, a portion of the composite particles remain on the fabrics intact at the end of the drying cycle so that fragrance may be released while the fabrics are being worn or ironed by the consumer.

The microcapsules of the present invention advantageously deposit a greater proportion of fragrance composition on drying clothes than prior art methods used in the art. Additionally, less fragrance is lost during the manufacturing of the tumble drier article of the invention over the art. Therefore, less of the perfume composition is needed to form the microcapsules to impart a greater proportion of perfume fragrance, such as the topnotes of the perfume, on fabrics. Diffusion of fragrance is further significantly reduced during storage so that the fragrance is efficiently used for the purpose of the invention, rather than perfuming the environment.

The microcapsules are relatively small and less than about 100 microns in diameter, preferably about 3 to about 100 microns and most preferably about 3 to about 40 microns. The particles embedded in the microcapsules have an average diameter of about 5 microns and preferably less than 1 micron. Spherical microcapsules are preferably, however, any geometric shape known in the art may be used within the scope of the invention.

Preferably the microcapsules are solid at also room temperature but may be in gel form.

Emulsifiable Material

The term "emulsifiable mixture" is used to refer to a mixture of wax and perfume, optionally containing a surfactant, which forms an emulsion upon melting and dispersing into water, and has a melting point of less than about 100° C., preferably 35° C. to 90° C. and most preferably from 45° C. to 85° C.

The melting point of the emulsifiable mixture is defined as the highest transition temperature (measurable by a conventional Differential Scanning Calorimeter) above the melting point at which the emulsifiable liquid becomes flowable or pourable.

The wax of the invention includes hydrocarbons such as paraffins and microcrystalline waxes. The optional surfactant includes cationic surfactants, preferably fabric softening materials; an ethoxylated primary alcohol, nonionic surfactants and preferably those derived from C16, C30, C40 or C50 average carbon chain length alcohols; anionic surfactants such as alkyl sulfonate, polymeric surfactants and mixtures thereof.

The paraffin and microcrystalline waxes used in the invention are preferably self-emulsifiable, but such self-emulsifiable waxes may be combined with non self-emulsifiable waxes to form a material within the scope of the invention.

Waxy materials which are contemplated within the scope of the present invention are presented in Table 1 below:

| Type | Company Designation | Supplier | Melting Point | HLB Value | Saponification Value |
|---|---|---|---|---|---|
| | | Self-Emulsifiable Waxy Materials | | | |
| Hydrocarbon | Duroxon J-324 | Durachem[1] | 105–115 | — | 20–30 |
| Hydrocarbon | Duroxon B-120 | Durachem[1] | 95–100 | — | 85–100 |
| Polyethylene | Bestowax AO-1539 | Durachem[1] | | — | 38–45 |
| Hydrocarbon | Durmont E | Durachem[1] | 68–72 | — | 80 |
| Hydrocarbon | Carnauba PV-0553 | Durachem[1] | 76–80 | — | 12–23 |
| Hydrocarbon | Durawax S | Durachem[1] | 70–74 | — | 165–170 |
| Hydrocarbon | WS-215 | Durachem[1] | 48–50 | — | 19 |
| Nonionic Surfactant | Unithox 420 | Petrolite[2] | 91 | 4 | — |
| Nonionic Surfactant | Unithox 450 | Petrolite[2] | 90 | 10 | — |
| Nonionic Surfactant | Unithox 750 | Petrolite[2] | 105 | 10 | |

-continued

| Type | Company Designation | Supplier | Melting Point | HLB Value | Saponification Value |
|---|---|---|---|---|---|
| | Non Self-Emulsifiable Waxy Materials | | | | |
| Long Chain Alcohol | C30-OH | — | — | — | — |
| Long Chain Alcohol | C50-OH | — | — | — | — |

[1]Durachem - Dura Commodities Corp., Atlanta, GA
[2]Petrolite - Petrolite Specialty Polymers Group, Tulsa, OK A non self-emulsifiable wax such as Unilin 700 may be combined with a self-emulsified wax such as Duroxon J-324 in approximately equal ratios to form a material within the scope of the invention. The ratio of self-emulsifiable wax to non self-emulsifiable wax is preferably in the range of about 3:1 to about 100% self-emulsifiable wax, and preferably about 1:1.

Another embodiment of the invention is the combination of a surfactant, such as a cationic fabric softening component with a paraffin wax in a ratio of about 1:1 fabric softening component to wax to form the particles in which the perfume composition is embedded.

Any conventional fabric softening component described below for use to form a tumble drier article may be used in combination with a wax or polymeric alcohol to form the particles of the microcapsules.

Water Soluble Polymers

The water soluble polymers which are suitable for use in the invention include synthetic polymers and natural or modified natural polymers with molecular weights of less than 100,000.

Example of synthetic water soluble polymers are:

(1) polyvinyl pyrrolidone;
(2) water soluble celluloses;
(3) polyvinyl alcohol;
(4) ethylene maleic anhydride copolymer;
(5) methyl vinyl ether maleic anhydride copolymer;
(6) polyethylene oxides;
(7) water soluble polyamide or polyester;
(8) copolymers or homopolymers of acrylic acid such as polyacrylic acid, polystyrene acrylic acid copolymers or mixtures of two or more;

Examples of water-soluble hydroxyalkyl and carboxyalkyl celluloses include hydroxyethyl and carboxymethyl cellulose, hydroxyethyl and carboxyethyl cellulose, hydroxymethyl and carboxymethyl cellulose, hydroxypropyl carboxymethyl cellulose, hydroxypropyl methyl carboxyethyl cellulose, hydroxypropyl carboxypropyl cellulose, hydroxybutyl carboxymethyl cellulose, and the like. Also useful are alkali metal salts of these carboxyalkyl celluloses, particularly and preferably the sodium and potassium derivatives.

Examples of water soluble natural and modified natural polymers are starch, gums and gelatin. Modified starch in its myriad of forms, including dextrins, is useful within the invention, as well as hydrolyzed gums and hydrolyzed gelatin. Various modified starches within the scope of the invention are described in Schoch et al., U.S. Pat. No. 2,876,160, herein incorporated by reference.

Suitable hydrolyzed gums within the invention include gum arabic, larch, pectin, tragacanth, locust bean, guar, alginates, carrageenans, cellulose gums such as carboxy methyl cellulose and karaya.

Modified starch suitable for the invention has a dextrose equivalent of 0.25 up to about 20, preferably 5 to 15.

A wide range of starch hydrolysates having dextrose equivalents of up to 95 are also useful. Until recently these starch hydrolysates, also called maltodextrins and dextrins were produced from various starches by acid hydrolysis. The hydrolysates resulting from this acid process are not completely soluble in water, and contain native starch. Suitable starches are derived from corn, waxy maise, tapioca, etc.

Perfume compositions

The perfume composition of the emulsifiable mixture is characterized as an oil composition which is insoluble but water dispersible and may be either volatile or nonvolatile. Perfume compositions should also be blended to impart aromas which compliment the products in which the microencapsules will be used. For example, tumble drier sheets may incorporate a lemon scent, woody scent, bouquet fragrance, etc. to impart the feeling of cleanliness and fine laundry.

Deofragrance compositions described in Hooper, U.S. Pat. Nos. 4,134,838 and 4,322,308 herein incorporated by reference may be utilized within the present invention.

Perfume is released from the microcapsules and deposited on fabrics by at least partially dissolving the water soluble polymer of the microcapsules. Fragrance diffuses from the exposed or released particles. When the temperature is subsequently applied to the particles the wax is substantially melted and the perfume diffusion rate is accelerated.

In the preferred embodiment, water left in washed fabrics at the end of the drying cycle substantially dissolves the water soluble polymer of the microcapsules which have deposited on the fabrics mostly by mechanical action in the tumbling dryer. Subsequently as temperatures in the dryer rise from about 40° C. upwards toward 60°-90° C. the wax of the deposited particles is substantially melted to release fragrance onto the fabrics at the end of the drying cycle. It may be understood that the skilled artisan may select waxes of higher melting points to control the release of the majority of the fragrance at the end of the cycle, within the scope of the invention.

In another aspect of the invention the microcapsules may be engineered to provide deposit of the microcapsules on dried fabrics and release of the fragrance only upon ironing using steam and high temperatures. Perspiration and body heat may also be used to release fragrance during wear by the consumer, an embodiment of particular interest when deo-fragrance is used to form the particles.

Process

The composite microcapsules are prepared by spray-drying an aqueous dispersion. The aqueous dispersion is formed by emulsifying together the wax material and fragrance oil to form an emulsified mixture. In a reaction equipped with a stirrer, temperature controller and condenser. The reactor is heated and maintained at a temperature until the wax material and perfume are melted to form a smooth uniform solution. Water is then added to the uniform solution to form an aqueous wax/-perfume emulsion. The emulsion is then cooled and the water soluble polymer is added to form a stable emulsion which is spray-dried to yield solid microcapsules containing particles of wax material and perfume.

If a surfactant is desired, it is added to the emulsified mixture in the reactor.

Tumble Drier Article

The formed composite microcapsules may be mixed with an effective amount of a fabric conditioning composition and coated onto a dispensing means to form a tumble drier article. Such articles both condition fabrics in a tumble drier and impart a pleasant fragrance. The fabric conditioning composition has a preferred melting (or softening) point of about 35° C. to about 150° C.

In one embodiment about 0.5% to about 80% of the composite microcapsules are mixed with the fabric conditioning composition, preferably about 1% to about 20% microcapsules are mixed with the conditioning composition and most preferably about 2% to about 10% microcapsules are mixed with the conditioning composition. Because the fragrance is incorporated into the microcapsules, fragrance loss during manufacturing, storage and use is significantly reduced over sheets containing fragrance incorporated by conventional means and by other encapsulation technologies in the art.

The fabric conditioning composition which may be employed in the invention is coated onto a dispensing means which effectively releases the fabric conditioning composition in a tumble dryer. Such dispensing means can be designed for single usage or for multiple uses. One such multi-use article comprises a sponge material releasably enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a hardened plug of the mixture. The action and heat of the dryer opens the bag and releases the composition to perform its softening.

A highly preferred article comprises the compositions containing a softener and a compatible organosilicone releasably affixed to a flexible substrate such as a sheet of paper or woven or non-woven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent", as used herein, is intended to mean a substrate with an absorbent capacity (i.e., a parameter representing a substrates ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water;
2. the specimen is immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply towel paper has a value of 5 to 6; and commercially available two-ply household toweling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e. an array of fibers in a carded web wherein partial orientation of the fibers is frequently present, as well as a completely haphazard distributional orientation), or substantially aligned. The fibers or filaments can be natural (e.g. wool, silk, jute, hemp, cotton, linen, sisal, or ramie) or synthetic (e.g. rayon, cellulose ester, polyvinyl derivatives, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 5 mm to 5 mm in length and are from 1.5 to 5 denier. Preferably, the fibers are at least partially oriented haphazardly, and are adhesively bonded together with a hydrophobic or substantially hydrophobic binder-resin. Preferably, the cloth comprises about 70% fiber and 30% binder resin polymer by weight and has a basis weight of from about 18 to 45 g per square meter.

In applying the fabric conditioning composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry, untreated substrate.

According to one preferred embodiment of the invention, the dryer sheet substrate is coated by being passed over a rotogravure applicator roll. In its passage over this roll, the sheet is coated with a thin, uniform layer of molten fabric softening composition contained in a rectangular pan at a level of about 15 g/square yard. Passage of the substrate over a cooling roll then solidifies the molten softening composition to a solid. This type of applicator is used to obtain a uniform homogeneous coating across the sheet.

Following application of the liquefied composition, the articles are held at room temperature until the composition substantially solidifies. The resulting dry articles, prepared at the composition substrate ratios set forth above, remain flexible; the sheet articles are suitable for packaging in rolls. The sheet articles can optionally be slitted or punched to provide a non-blocking aspect at any convenient time if desired during the manufacturing process.

The fabric conditioning composition employed in the present invention includes certain fabric softeners which can be used singly or in admixture with each other.

Fabric Softener Component

Fabric softeners suitable for use herein are selected from the following classes of compounds:

(i) Cationic quaternary ammonium salts. The counterion is methyl sulfate or any halide, methyl sulfate being preferred for the drier-added articles of the invention. Examples of cationic quaternary ammonium salts include, but are not limited to:

(1) Acyclic quaternary ammonium salts having at least two $C_{8-30}$, preferably $C_{12-22}$ alkyl chains, such as: ditallow dimethyl ammonium methylsulfate, di(hydrogenated tallow)dimethyl ammonium methylsulfate, distearyldimethyl ammonium methylsulfate, dicocodimethyl ammonium methylsulfate and the like;

(2) Cyclic quaternary ammonium salts of the imidazolinium type such as di(hydrogenated tallow)-dimethyl imidazolinium methylsulfate, 1-ethylene-bis(2-tallow-1-methyl)imidazolinium methylsulfate and the like;

(3) Diamido quaternary ammonium salts such as: methyl-bis(hydrogenated tallow amidoethyl)-2-hydroxyethyl ammonium methyl sulfate, methyl bis(tallowamidoethyl)-2-hydroxypropyl ammonium methylsulfate and the like;

(4) Biodegradable quaternary ammonium salts such as N,N-di(tallowoyl-oxy-ethyl)-N,N,-dimethyl ammonium methyl sulfate and N,N-di(tallowoyl-oxy-propyl)-N,N-dimethyl ammonium methyl sulfate. When fabric conditioning compositions employ biodegradable quaternary ammonium salts, pH of the composition is preferably adjusted to between about 2 and about 5. Biodegradable quaternary ammonium salts are described, for example, in U.S. Pat. Nos. 4,137,180, 4,767,547, and 4,789,491 incorporated by reference herein.

(ii) Tertiary fatty amines having at least one and preferably two C8 to C30, preferably C12 to C22 alkyl chains. Examples include hardened tallow amine and cyclic amines such as 1-(hydrogenated tallow)amidoethyl-2-(hydrogenated tallow) imidazoline. Cyclic amines which may be employed for the compositions herein are described in U.S. Pat. No. 4,806,255 incorporated by reference herein.

(iii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkyl phenols, ethoxylated alkyl phenols, ethoxylated fatty amines, ethoxylated monoglycerides and ethoxylated diglycerides.

(iv) Mineral oils, and polyols such as polyethylene glycol.

These softeners are more definitively described in U.S. Pat. No. 4,134,838 incorporated by reference herein. Preferred fabric softeners for use herein are acyclic quaternary ammonium salts, di(hydrogenated)-tallow dimethyl ammonium methylsulfate is most preferred for dryer articles of this invention. Especially preferred are mixtures of di(hydrogenated)tallow dimethyl ammonium methylsulfate with fatty acids, particularly stearic acid.

The amount of the fabric softening composition on a sheet is subject to normal coating parameters such as, for example, viscosity and melting point of the fabric softening component and is typically about 0.5 grams to about 5 grams, preferably about 1 gram to about 3.5 grams.

Optional ingredients include brighteners or fluorescent agents, colorants, germicides and bactericides.

The following examples will more fully illustrate the embodiments of this invention. All parts, percentages and proportions refer to herein and in the claims are by weight unless otherwise indicated.

EXAMPLE 1

An emulsion containing a blend of a self-emulsifiable wax, a non self-emulsifiable wax and a perfume mixture dispersed in polyvinyl alcohol solution was prepared by the following process. 20 g of the self-emulsifiable Duroxon J-324 wax (M.P. 105°-115° C., Durachem), 20 g of non self-emulsifiable Unilin 700 Wax (M.P. 110° C., Petrolite), 0.50 g of potassium hydroxide and 20 g of deionized water were charged to a 500 ml reactor equipped with stirrer, temperature controller and condenser. The reactor was heated and maintained at 100° C. until all the wax melt to form a smooth uniform solution. 16 g of boiling deionized water was added slowly to the molten wax mixture and the temperature was maintained at 100° C. until a crystal clear solution was observed. Following this, 44 g of perfume (ex-International Flavors & Fragrances) was added slowly to the wax mixture at 100° C. to yield a honey like viscous solution. 80 g of boiling deionized water was then added to the reactor to form a milky wax/perfume mixture emulsion. To this emulsion, 136 g of polyvinyl alcohol solution (Molecular Weight 2,000, 17.6% solid) was added and the emulsion was cooled to 40°-50° C. with a water bath to form a stable emulsion. The resulting emulsion was spray dried at 120° C. inlet air temperature and 60° C. outlet air temperature using Yamato GA 31 minispray dryer to yield the microcapsule with 40% perfume loading.

EXAMPLE 2

An emulsion containing a blend of self-emulsifiable wax and perfume dispersed in a polyvinylalcohol solution was prepared as follows. To a 1 liter reactor equipped with stirrer, temperature controller and condenser was charged 45 g of self-emulsifiable Unithox 450 wax (m.p. 90° C., Petrolite). The reactor was heated and maintained at 95° C. until all the wax melt. 90 g of perfume (ex-IFF) was added slowly to the reactor for a period of 5 to 8 minutes and the temperature was maintained at 90° C. to form a clear solution. Following this, 222 g of hot deionized water (90° C.) was added to the mixture of molten wax and perfume to form a milky emulsion. 390 g of polyvinylalcohol solution (Molecular Weight 2,000, 23.1% solid) was added to the reactor and the emulsion was cooled to 40°-50° C. with a water bath. The resulting emulsion was then spray dried at 150° C. inlet air temperature and 70° C. air outlet temperature using Yamato GA31 minispray dryer to make the microcapsule with 40% perfume loading.

EXAMPLE 3

An emulsion containing a blend of self-emulsifiable wax and perfume dispersed in a polyvinylalcohol solution was prepared as follows. To a 1 liter reactor equipped with stirrer, temperature controller and condenser was charged 22.5 g of Unithox 450 wax and 22.5 g of ditallowdimethylammonium methylsulfate. The reactor was heated and maintained at 95° C. until all the wax melt. 90 g of perfume (ex-IFF) was added slowly to the reactor for a period of 5 to 8 minutes and the temperature was maintained at 90° C. to form a clear solution. Following this, 222 g of hot deionized water (90° C.) was added to the mixture of molten wax and perfume to form a milky emulsion. 390 g of polyvinylalcohol solution (Molecular Weight 2,000, 23.1% solid) was added to the reactor and the emulsion was cooled to 40°-50° C. with a water bath. The resulting emulsion was then spray dried at 150° C. inlet air temperature and 70° C. air outlet temperature using Yamato GA31 minispray dryer to make the microcapsule with 40% perfume loading.

EXAMPLE 4

An emulsion containing a blend of self-emulsifiable wax and perfume dispersed in a polyvinylalcohol solution was prepared as follows. To a 1 liter reactor equipped with stirrer, temperature controller and condenser was charged 45 g of self-emulsifiable Unithox 750 wax (m.p. 110° C., Petrolite). The reactor was heated and maintained at 95° C. until all the wax melt. 90 g of perfume (ex-IFF) was added slowly to the reactor for a period of 5 to 8 minutes and the temperature was maintained at 90° C. to form a clear solution. Following this, 222 g of hot deionized water (90° C.) was added to the mixture of molten wax and perfume to form a milky emulsion. 390 g of polyvinylalcohol solution (Molecular Weight 2,000, 23.1% solid) was added to the reactor and the emulsion was cooled to 40°-50° C. with a water bath. The resulting emulsion was then spray dried at 150° C. inlet air temperature and 70° C. air outlet temperature using Yamato GA31 minispray dryer to make the microcapsule with 40% perfume loading.

EXAMPLE 5

An emulsion containing a blend of self-emulsifiable wax and perfume dispersed in a hydrophobically modified starch solution was prepared as follows. To a 500 ml reactor equipped with stirrer, temperature controller and condenser was charged 30 g of self-emulsifiable Unithox 450 wax (m.p. 90° C., Petrolite). The reactor was heated and maintained at 95° C. until all the wax melt. 60 g of perfume (ex-IFF) was added slowly to the reactor for a period of 5 to 8 minutes and the temperature was maintained at 90° C. to form a clear solution. Following this, 90 g of hot deionized water (90° C.) was added to the mixture of molten wax and perfume to form a milky emulsion. 100 g of Capsul solution (National Starch and Chemical Corp., 30% solid) was added to the reactor and the emulsion was cooled to 40°-50° C. with a water bath. The resulting emulsion was then spray dried at 120° C. inlet air temperature and 60° C. air outlet temperature using Yamato GA31 minispray dryer to make the microcapsule with 50% perfume loading.

Characteristics of Capsules

The composition and the characteristics of the prepared capsules are shown in Table I. The % washable perfume oil is determined by washing the capsule with n-hexane. Two grams of capsule are weighed into a Buchner funnel. 40 g of hexane is added to the funnel. The hexane is removed by applying the house vacuum and the washed capsule is air dried to a constant weight. The % washable oil is then calculated form the amount of perfume oil removed and the total oil contained in the capsule.

TABLE I

| Capsule | Composition | % Washable Oil |
|---|---|---|
| Example 1 | 40.8% Perfume, 18.6% Duroxon J-324 18.6% Uniline 700, 22% PVA | 44% |
| Example 2 | 40% Perfume, 20% Unithox 450 40% PVA | 1.3% |
| Example 3 | 40% Perfume, 10% Unithox 450 10% Ditallowdimethylammonium Methyl Sulfate 40% PVA | 1.6% |
| Example 4 | 40% Perfume, 20% Unithox 750 40% PVA | 3.75% |
| Example 5 | 50% Perfume, 25% Unithox 450 25% Capsul ® | 66% |

EXAMPLE 6

This example gives a comparison of the result obtained by using a mixture of nonemulsifiable core material for the preparation of perfume/wax microcapsules by the same process described in example 2. 19 g of C30 alcohol (Uniline 425, ex-Petrolite) was charged into a 500 ml reactor. The reactor was heated and maintained at 95° C. until all the wax melted. 19 g of perfume (ex IFF) was added slowly to the molten wax and the temperature was maintained at 90° C. to form a clear solution. 114 g of hot deionized water was then added to the reactor. Following this addition, 152 g of polyvinylalcohol solution (25% solid, 2,000 MW) was added to the reactor and the reactor was cooled to 40° C. with a water bath. It was observed that instead of forming a stable emulsion, the wax/perfume mixture formed large aggregates which could not be spray dried.

EXAMPLE 7

A wax and perfume mixture were encapsuled in a modified starch Capsul (ex-National Starch and Chemical Corp.) using the process described in U.S. Pat. No. 3,091,567. Capsul is a modified food starch derived from waxy maize especially designed for spray drying encapsulation of perfumes and flavors. 40 g of Capsule and 160 g of deionized water were added to a 500 ml reactor. The reactor was heated and maintained at 90° C. until all the Capsul dissolved. At the same time, a wax and perfume mixture was prepared by melting 20 g of Uniline 425 wax (ex-Petrolite) and 20 g of perfume (ex-IFF) at 90° C. The wax and perfume mixture was added to the reactor and agitated with the Capsul solution at 90° C. for 30 minutes. The resulting emulsion was then cooled to 40° C. with a water bath. Rather than forming a stable emulsion, the wax and perfume mixture formed large aggregates which could not be spray dried.

EXAMPLE 8

Microcapsules were formed using polyvinyl alcohol by the process described in Example 2. In this example, the core material is perfume only, without wax. 40 g of perfume (ex-IFF) was emulsified into 164 g of polyvinyl alcohol (24.5% solid, 2,000 M.W.) to form a stable perfume emulsion. The perfume emulsion was spray dried at 120° inlet air temperature and 60° C. outlet air temperature using Yamato GA31 minispray dryer. The sprayed emulsion was heavily coated on the wall of drying chamber and could not be used to produce free flowing perfume capsules.

EXAMPLE 9

Fabric Softener Sheet Preparation

Fabric softener dryer sheets comprising a perfume-containing fabric softener composition coated on a polyester substrate are prepared as follows. The perfume-containing softener active composition is prepared by admixing 36 grams of perfume microcapsule with 900 grams of molten softener active comprising 70 wt. % ditallowdimethylammonium methylsulfate and 30 wt. % C16–C18 fatty acid at 75° C. for 4–6 minutes. After the addition is completed, the molten softener active is transferred to a 3-roller Lyons Bench Coater preheated to 79° C. The molten softener active is then coated on 9 inches by 11 inches polyester substrate with a coating weight 1.6 grams per sheet. The perfume microcapsules of Example 2 and Example 3 are used for the sheet preparation. Same procedure is also used to make one softener sheet containing 4 wt. % of free perfume oil.

EXAMPLE 10

Fabric Perfume Odor Test

This test compares the effectiveness of perfume microcapsule vs. free (non-encapsulated) perfume oil in perfume substantivity to fabric after a dryer cycle. In this test, 6 lbs. of freshly washed fabrics are dried for 40 minutes in a Kenmore electric dryer (Lady Kenmore). At the start of drying cycle, a 9 inches of 11 inches perfume-containing fabric softener sheet is placed on the top of the clothes. Two dryers are used for the test. In one drier the sheet contains the free perfume oil is used while in the other drier contains the perfume microcapsule. At the end of the drying cycle, the fabrics are removed from the dryer. The odor from the treated fabrics is compared. Evaluation results (Table II) shows that fabrics treated with the sheet containing either Example 2 or Example 3 microcapsule gives stronger perfume odor than those treated with the sheet containing the free perfume oil even at a lower total perfume level (1.6 wt. % vs. 4 wt. %).

TABLE II

| | % Perfume | % Perfume Capsule | Perfume Odor |
|---|---|---|---|
| Sheet 1 | 4% | None | Weak |
| Sheet 2 | 1.6% | 4% Example 2 | Stronger |
| Sheet 3 | 1.6% | 4% Example 3 | Stronger |

We claim:

1. A tumble drier article of manufacture adopted for conditioning fabric in an automatic clothes drier comprising:

(a) a fabric softening composition comprising a fabric softener selected from the group consisting of a cationic quaternary ammonium salt, a tertiary fatty amine having at least one $C_8$ to $C_{30}$ alkyl chain, a carboxylic acid having 8 to 30 carbon atoms and one carboxylic group per molecule, a polyhydric alcohol ester, a fatty alcohol, an ethoxylated fatty alcohol, an alkyl phenol, an ethoxylated alkyl phenol, an ethoxylated fatty amine, an ethoxylated fatty monoglyceride, an ethoxylated diglyceride, a mineral oil, a polyol and mixtures thereof;

b) about 1 to about 20% sprayed dried composite microcapsules, each microcapsule comprising a water soluble polymer matrix en-casing particles formed from an emulsifiable mixture of wax material and a perfume composition, the wax material having a melting point of about 35° to about 90° C., the water soluble polymer selected from the group consisting of a synthetic polymer, a natural or modified natural polymer having a molecular weight of about 100,000 and mixtures thereof; and (c) dispensing means for releasing the fabric softening composition and the microcapsules onto fabrics, the fabric softening composition releasably attached to the dispensing means in a weight range of from about 10:1 to 0.5:1 of the fabric softening composition to the dispensing means.

2. The tumble drier article according to claim 1 wherein the wax material is selected from the group consisting of a hydrocarbon based paraffin wax and a hydrocarbon based microcrystalline wax.

3. A tumble drier article according to claim 1, wherein the emulsifiable mixture of the wax material and the perfume composition further comprises a surfactant selected from the group consisting of a cationic surfactant, an ethoxylated primary alcohol, a nonionic surfactant, an anionic surfactant and mixtures thereof.

4. The tumble drier article according to claim 3, wherein the surfactant is a nonionic surfactant derived from C16, C30, C40 or C50 average carbon chain length alcohols, a cationic fabric softening component, or mixtures thereof.

5. The tumble drier article according to claim 3, wherein the surfactant is the ethoxylated primary alcohol or the cationic fabric softening compound.

6. The tumble drier article according to claim 1, wherein the synthetic polymer is a material selected from the group consisting of polyvinyl pyrrolidone, a water soluble cellulose, a polyvinyl alcohol, a polyethylene oxide, a homo- or copolymer of acrylic acid and/or methacrylic acid, ethylene maleic anhydride copolymer, methyl vinyl ether maleic anhydride copolymer, a water soluble polyamide or polyester, or mixtures thereof.

7. The tumble drier article to claim 7 wherein the synthetic polymer is the polyvinyl pyrrolidone or the polyvinyl alcohol.

8. A tumble drier article according to claim 1 wherein the natural polymer is a starch, a gum, or a gelatin.

9. A tumble drier article according to claim 1 wherein each of the composite microcapsules have a diameter of less than 100 microns.

10. A tumble drier article according to claim 9 wherein each microcapsule has a diameter of about 3 to about 100 microns.

11. A tumble drier article according to claim 10 wherein each of the microcapsules has a diameter of about 3 to about 40 microns.

12. A tumble drier article according to claim 1 wherein the particles have an average diameter of less than about 5 microns.

13. A tumble drier article according to claim 12 wherein the particles have an average diameter of less than about 1 micron.

14. The tumble drier article according to claim 1 wherein the article comprises about 0.5% to about 80% of the composite microcapsules.

* * * * *